US009732964B2

(12) United States Patent
Lee et al.

(10) Patent No.: US 9,732,964 B2
(45) Date of Patent: Aug. 15, 2017

(54) ELECTRIC OVEN

(75) Inventors: Young Jun Lee, Changwon-si (KR); Hyun Jung Kim, Changwon-si (KR); Dong Seong Kwag, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 962 days.

(21) Appl. No.: 13/977,988

(22) PCT Filed: Feb. 11, 2011

(86) PCT No.: PCT/KR2011/000934
§ 371 (c)(1),
(2), (4) Date: Jul. 2, 2013

(87) PCT Pub. No.: WO2012/108570
PCT Pub. Date: Aug. 16, 2012

(65) Prior Publication Data

US 2013/0299485 A1 Nov. 14, 2013

(51) Int. Cl.
*A21B 1/00* (2006.01)
*F24C 7/06* (2006.01)
(Continued)

(52) U.S. Cl.
CPC ..... *F24C 7/065* (2013.01); *F24C 7/043* (2013.01); *F24C 7/046* (2013.01); *F24C 15/22* (2013.01)

(58) Field of Classification Search
CPC ..... F24C 15/22; F24C 7/043; F24C 7/046; F24C 7/065; F24C 15/327; F24C 15/007;
(Continued)

(56) References Cited

U.S. PATENT DOCUMENTS 5,287,799 A 2/1994 Pickering et al.
8,538,249 B2 * 9/2013 Shaffer ..... F24C 7/06 392/407
(Continued)

FOREIGN PATENT DOCUMENTS

JP 09-159179 * 6/1997
JP H09-159179 A 6/1997
(Continued)

OTHER PUBLICATIONS

Korean Notice of Allowance dated Aug. 29, 2014 issue in Application No. 10-2012-7017971.
(Continued)

*Primary Examiner* — Dana Ross
*Assistant Examiner* — Joseph Iskra
(74) *Attorney, Agent, or Firm* — KED & Associates, LLP

(57) ABSTRACT

The present invention relates to an electric oven. The electric oven according to an embodiment of the present invention includes a cavity which is provided with an oven chamber, a door for opening and closing alternatively the oven chamber, a carbon heater for providing radiant energy to the inside of a cooking room through the communication opening, a reflector for reflecting the radiant energy from the carbon heater to the inside of the cooking room, and a grate which is fixed to the reflector and is disposed on the communication opening and is provided with a forming section a part of which is formed toward the reflector. Therefore, the grate can be prevented from being damaged according to the electric oven of the present invention.

12 Claims, 8 Drawing Sheets

(51) Int. Cl.
*F24C 7/04* (2006.01)
*F24C 15/22* (2006.01)

(58) Field of Classification Search
CPC .. F24C 15/08; F24C 7/06; F24C 7/062; F24C 7/067; F24C 7/08; F24C 7/081; F24C 7/082; A47J 27/04; A47J 27/62; A47J 27/002; Y10T 29/49815; B23P 19/00
USPC ..... 219/200, 385, 391, 399, 400, 402, 405, 219/409; 126/1, 1 R, 19 R, 21 R, 21 A; 99/324, 325
See application file for complete search history.

(56) References Cited

U.S. PATENT DOCUMENTS

| | | | | |
|---|---|---|---|---|
| 2010/0095951 | A1* | 4/2010 | Ahmed | A47J 37/0713 126/39 D |
| 2011/0049125 | A1* | 3/2011 | Home | A47J 37/0709 219/405 |

FOREIGN PATENT DOCUMENTS

| | | | |
|---|---|---|---|
| JP | 2001-182947 | A | 7/2001 |
| KR | 20-1998-0023366 | U | 7/1998 |
| KR | 20-2000-0010884 | U | 6/2000 |
| KR | 20-0236789 | Y1 | 9/2001 |
| KR | 10-2006-0082253 | | 7/2006 |
| KR | 10-0697024 | B1 | 3/2007 |
| KR | 10-2009-0071266 | A | 7/2009 |
| KR | 10-2010-0124957 | A | 11/2010 |
| KR | 1020100124957 | * | 11/2010 |
| KR | 10-2011-0089700 | | 8/2011 |

OTHER PUBLICATIONS

Korean Office Action dated Feb. 15, 2016 issued in Application No. 10-2010-0009209.
Korean Office Action dated Feb. 15, 2016 issued in Application No. 10-2010-0009324.
International Search Report issued in PCT Application No. PCT/KR2011/000934 dated Nov. 9, 2011.

* cited by examiner

ELECTRIC OVEN

CROSS-REFERENCE TO RELATED PATENT APPLICATIONS

This application is a U.S. National Stage Application under 35 U.S.C. §371 of PCT Application No. PCT/KR2011/000934, filed Feb. 11, 2011.

TECHNICAL FIELD

The present invention relates to an electric oven.

BACKGROUND ART

In general, an electric oven is a device for preparing food using electric. Further, as for the electric oven, various type-heaters are provided as a heating source for preparing food in a cooking room. The heaters each may include a reflector for reflecting radiant energy produced from the heater inside the cooking room, or the heaters each may be shielded by a heater cover for preventing the radiant energy from being leaked outside.

However, in an electric oven provided with a carbon heater according to a prior art, grate provided therein may be damaged due to the radiant energy from the carbon heater. Specially, in case where the grate size is increased as a size of the carbon heater increases, the grate may be deformed thermally due to the radiant energy from the carbon heater.

Additionally, a bar-type heater has been used in the electric oven according to a prior art, and thus the reflector or the heater cover is to be shaped in consideration of the shape of the heater. However, the reflector or the heater cover that is applicable to the various shape-heaters has not been proposed.

Further, since the reflector or the heater cover applicable to the various shape-heaters have not been proposed, the reflection of the radiant energy from the various shape-heaters through the reflector or the leakage prevention of the radiant energy through the heater cover is not to be ensured sufficiently. Accordingly, it cannot be expected for food to be prepared efficiently using the heater.

DISCLOSURE

Technical Problem

The present invention has been proposed to solve the drawbacks as described above and an object of the present invention relates to provide an electric oven in which damage to the grate can be prevented.

Another object of the present invention relates to provide an electric oven in which various shape-heaters can be used.

Still another object of the present invention relates to provide an electric oven configured to cook efficiently food.

Technical Solution

According to an aspect of the present invention, the electric oven includes: a cavity which is provided with an oven chamber and to which communication openings are formed; a door for opening and closing alternatively the oven chamber; a carbon heater for providing radiant energy to the inside of a cooking room through the communication opening; a reflector for reflecting the radiant energy from the carbon heater to the inside of the cooking room; and a grate which is fixed to the reflector and is disposed on the communication opening and is provided with a forming section a part of which is formed toward the reflector.

According to another aspect of the present invention, the electric oven includes: a cavity which is provided with an oven chamber and to which a communication opening is provided; a carbon heater that provides the radiant energy to the inside of the oven chamber and includes a straight line part; a reflector for reflecting the radiant energy of the carbon heater to the inside of the oven chamber; and a grate which is disposed on the communication opening and to which a plurality of communication holes for transferring the radiant energy from the carbon heater to the inside of the oven chamber are provided wherein the communication holes are formed lengthwise in another direction except for the parallel direction with the straight line part of the carbon heater.

According to another aspect of the present invention, the electric oven includes: a cavity which is provided with an oven chamber and to which a communication opening is provided; a carbon heater that provides the radiant energy to the inside of the oven chamber and includes a straight line part; a reflector for reflecting the radiant energy of the carbon heater to the inside of the oven chamber; and a grate which is disposed on the communication opening and to which a plurality of communication holes for transferring the radiant energy from the carbon heater to the inside of the oven chamber are provided wherein the communication holes are extended at a preset angle and form rows in a direction perpendicular to the extended direction, and the imaginary lines in parallel with the straight line part of the carbon heater interest at least one of the communication holes.

It should be understood that different embodiments of the invention, including those described under different aspects of the invention, are meant to be generally applicable to all aspects of the invention. Any embodiment may be combined with any other embodiment unless inappropriate. All examples are illustrative and non-limiting.

Advantageous Effects

According to the electric oven of the present invention, the following effects can be expected.

In the present invention, the grate is fixed substantially to the reflector in order to prevent the carbon heater from being damaged. Accordingly, a phenomenon that the grate is thermally deformed by the radiant energy from the carbon heater and drooped to the inside of the oven chamber can be prevented.

Further, in the present invention, since at least a part of the carbon heater is disposed to overlap vertically the communication hole formed on the grate, a phenomenon that the carbon heater and the floor face of the grate are overlapped vertically can be prevented. Accordingly, the radiant energy of the carbon heater that is transmitted to the oven chamber is not interrupted by the grate and thus the radiant energy of the carbon heater is transmitted efficiently to the inside of the cooking room.

In addition, in the present invention, the reflector is shaped, corresponding to the shape of the heater, including a straight line part and curved line part. Accordingly, a heater having a relatively large area for producing the radiant energy, for example, U-type heater, may be used.

Further, in the present invention, the reflector is shaped for the heat from the carbon heater to be reflected to the inside of the cooking room. Accordingly, food can be cooked more efficiently.

BEST MODE

Figure 1:
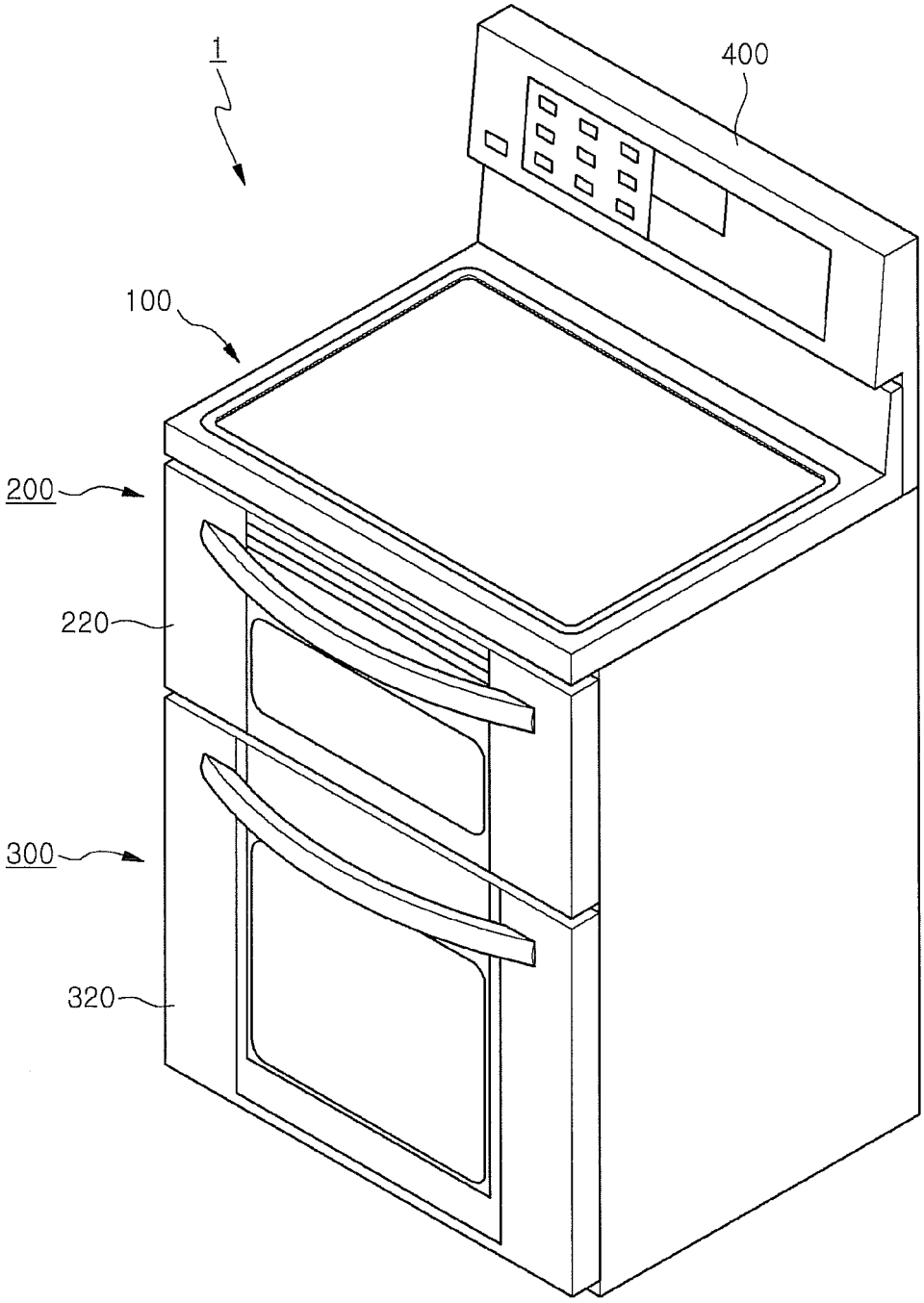
FIG. 1 is a perspective view showing an electric oven according to a first embodiment of the present invention.

Exemplary embodiments of the present invention will be described below in more detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Throughout the disclosure, like reference numerals refer to like parts throughout the various figures and embodiments of the present invention.

Figure 2:
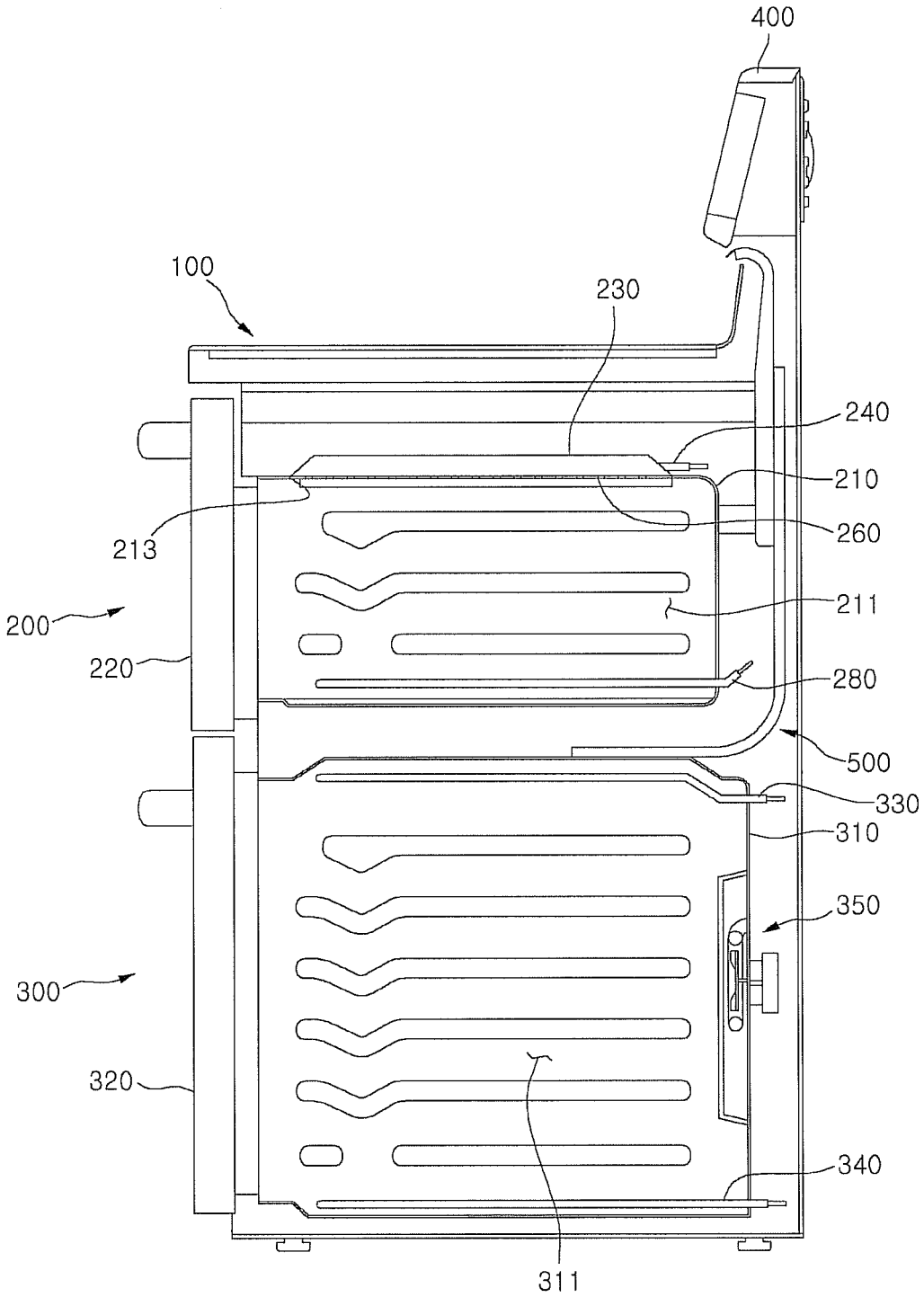
FIG. 2 is a longitudinal-sectional view showing an electric oven according to a first embodiment of the present invention.

First, referring to FIGS. 1 and 2, a cook top 100 may be provided on a top of a main body 1 of an electric oven. Here, a plurality of cook top heaters (not shown) may be provided inside the cook top 100. Generally, food is cooked by the cook top heaters in the cook top 100.

Further, a first oven section 200 and a second oven section 300 may be provided inside the main body 1, corresponding to the lower part of the cook top 100. Here, food may be cooked independently in the first oven section 200 and the second oven section 300. In the present embodiment, the first oven section 200 and the second oven section 300 are laminated vertically and the first oven section 200 is formed comparatively smaller than the second oven section 300. Detailed description of the first and second oven sections 200, 300 will be described later.

In addition, a control panel 400 may be provided on upper rear end of the main body 1, corresponding to a rear part of the cook top 100. Here, the control panel 400 receives a signal for operating the first and second oven sections 200, 300, that is, for cooking food in top cooking section 100, and the first and second oven sections 200, 300, and outputs information of cooking food in the cook top 100, and the first and second oven sections 200, 300. Of course, a separate control panel for only the cook top 100 may be provided, for receiving a signal to operate the cook top 100 and outputting the information of an operation of the cook top 100.

Figure 3:
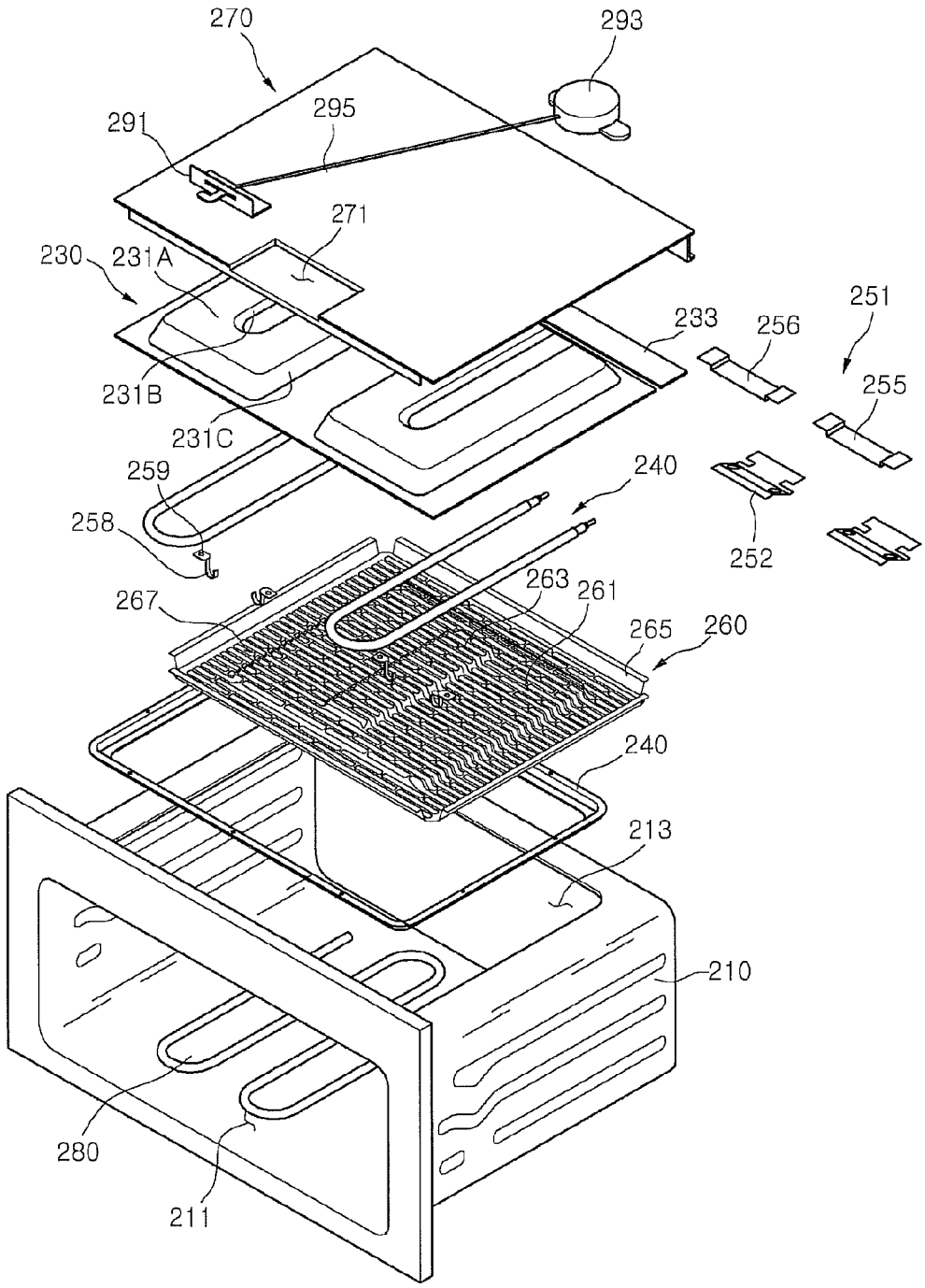
FIG. 3 is an exploded-perspective view showing main parts of the electric oven according to a first embodiment of the present invention.

Meanwhile, referring to FIGS. 2 and 3, the first oven section 200 may include a first cavity 210 and a first door 220. A first cooking room 211 may be provided inside the first cavity 210, where food is to be cooked. A communication opening 213 may be provided on an upper face of the cavity 210. Here, the communication opening 213 is formed by cutting a part of upper face of the first cavity 210. Further, the first door 220, for example, may be a pull-down way in which the upper end is rotated vertically around the lower end to open and close alternatively the first cooking room 211.

Meanwhile, a reflector 230 may be provided on an upper face of the first cavity 210. The reflector 230 serves to reflect radiant energy from a carbon heater, which will be described later, to the inside of the first cooking room 211. Further, a predetermined space for partitioning the first cooking room 211 from the first cooking room 211 is formed inside the reflector 230. That is, the reflector 230 may shield substantially the communication opening 213. Accordingly, the reflector 230 may be named as a shielding member for shielding the communication opening 213. Further, the inner space of the reflector 230 is communicated to the first cooking room 211 through the communication opening 213.

Additionally, a plurality of heater seating section 231 may be provided in the reflector 230. In the present embodiment, two heater seating sections 231 are provided in the reflector 230. The heater seating section 231 may be shaped corresponding to the shape of the carbon heater 240. For example, the heater seating section 231 is configured by forming a part of the reflector 230 in a spaced-direction from the first cooking room 211. Accordingly, the heater seating section 231 may be a polyhedron shape in which the bottom face is opened. At this time, a longitudinal section of the heater seating section 231 may be approximately a trapezoid shape. Therefore, a cross-section of the heater seating section 231 is a similar shape of different sizes, depending on the distance from the reflector 230, that is, it is corresponded to a shape of the carbon heater 240. For example, the cross-section of the heater seating section 231 is formed to decrease in size as spaced gradually from the reflector 230.

Meanwhile, the heater seating section 231 has a top face 231A, and peripheral faces 231B 231C. The top face 231A of the heater seating section 231 may be shaped, corresponding to a shape of the carbon heater 240. Further, the peripheral faces of the heater seating section 231 may connect the reflector 230 and the top face of the heater seating section 231. At this time, the peripheral faces 231B 231C of the heater seating section 231 may be inclined at a predetermined angle with respect to the reflector 230 and the top face 231A of the heater seating section 231. Accordingly, a longitudinal section of the heater seating section 231 may be in a trapezoid shape, and a cross-section of the heater seating section 231 may be formed in a similar shape of different size, depending on the distance from the reflector 230.

In the present embodiment, a cross-section of the inner peripheral surface 231B of the heater seating section 231, corresponding to the inner part of the heater seating section 231, is formed as a full U-shape. Accordingly, the distance between the inner peripheral surface 231B of the heater seating section 231 and the outer peripheral surface of the carbon heater 240 that is formed substantially as U shape is equal, regardless of the location of the carbon heater 240. Further, a cross-section of the outer peripheral surface 231C of the heater seating section 231, corresponding to the outer part of the heater seating section 231, may be formed as oblong shape in which the edge is rounded.

Meanwhile, a part of the reflector 230 that is surrounded by the inner peripheral surface 231B of the heater seating section 231 may be stepped from the rest part of the reflector 230. In the present embodiment, the part of the reflector 230 that is surrounded by the inner peripheral surface 231B of the heater seating section 231 may be disposed between the rest part of the reflector 230 and the top face 231A of the heater seating section 231.

Further, the carbon heater 240 may be disposed inside the heater seating section 231, respectively. Here, the number of the heater seating section 231 may be selected depending on the number of the carbon heater 240. The heater seating section 231 may be disposed lengthwise in front and rear side directions of the reflector 230 and two heater seating sections may be spaced at a predetermined distance in left and right side directions of the reflector 230.

Additionally, two heater-through openings 232 (referring to FIGS. 6 and 7) may be formed on one face of the heater seating section 231, respectively. Here, the heater-through opening 232 may be formed by cutting a part of the heater seating section 231. At this time, the heater-through opening 232, for example, may have a diameter being equal to or greater than the diameter of the tube 241, which will be described later, to minimize the contact between the heater-through opening 232 and the tube 241.

Further, a barrier section 233 may be provided on a rear end of the reflector 230 adjacent to the heater seating section 231 on which the heater-through opening 232 is formed. The barrier section 233 may be extended rearward from a rear end of the reflector 230 at a predetermined distance. The barrier section 233 may be disposed substantially between a top face of the first cavity 210 and the carbon heater 240. The barrier section 233 may serve to prevent the internal heat of the first cooking room 211 from being transferred to the carbon heater 240 through the first cavity 210.

The bottom face periphery of the reflector 230 may be fixed to the top face of the first cavity 210, corresponding to the periphery of the communication opening 213. That is, the bottom face periphery of the reflector 230 may be fixed to a heater base 235, which will be described later, through a fastening device (not shown). Further, the grate 260, which will be described later, may be fixed to a central part of the bottom face of reflector 230, that is, the central part of the bottom face of reflector 230 corresponding to a place between the heater seating section 231.

Meanwhile, the heater base 235 may be provided between the first cavity 210 and the reflector 230. The heater base 235 may be fixed to the top face of the first cavity 210. For example, the heater base 235 may be fixed to the top face of the first cavity 210 by a welding, etc. Further, the bottom face periphery of the reflector 230 may be fixed to the heater base 235 that is fixed to the top face of the first cavity 210.

Figure 6:
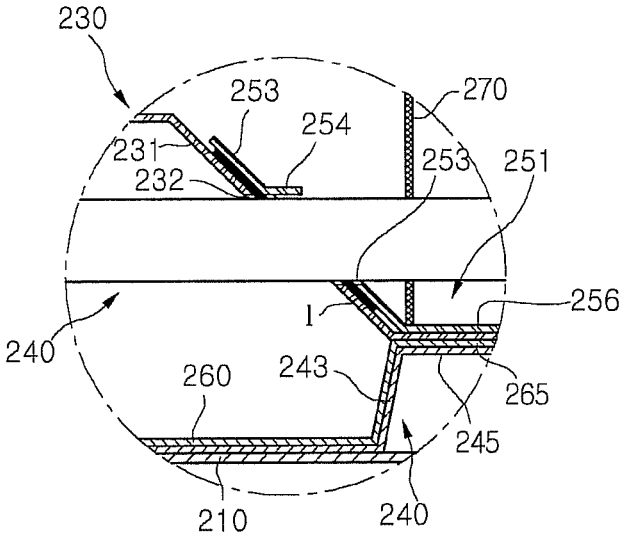
FIG. 6 is a longitudinal-sectional view showing main parts of the electric oven according to a first embodiment of the present invention.

Referring to FIGS. 3 and 6, the heater base 235 may include a first fixing section 236, a connection section 237 and a second fixing section 238. The first fixing section 236 of the heater base 235 may be a place that is fixed to the top face of the first cavity 210, that is, the top face of the first cavity 210 adjacent to the communication opening 213. The connection section 237 of the heater base 235 serves to connect the first fixing section 236 and the second fixing section 238 of the heater base 235. Further, the second fixing section 238 of the heater base 235 may be a place that is fixed to the reflector 230.

In more detail, the first fixing section 236 of the heater base 235 may be fixed to the top face of the first cavity 210, that is, the top face of the first cavity 210 adjacent to the communication opening 213. Here, the first fixing section 236 of the heater base 235 may be formed as a frame shape in which the inner periphery of the first fixing section is adjacent to the communication opening 213.

The connection section 237 of the heater base 235 may be extended upward from the outer periphery of the first fixing section 236 of the heater base 235. The connection section 237 of the heater base 235, for example, may be extended such that it is inclined to become more distance from the communication opening 213 in the outer periphery of the first fixing section 236 of the heater base 235. Of course, the connection section 237 of the heater base 235 may be extended perpendicularly to the second fixing section 236.

The connection section 237 of the heater base 235 may connect the first and second fixing sections 236, 238 such that the second fixing section 238 of the heater base 235 may be elastically deformed with respect to the first fixing section 236 of the heater base 235 to absorb external force for preventing the carbon heater 240 from being damaged.

Further, the second fixing section 238 of the heater base 235 may extended horizontally at a front end of the connection section 237 of the heater base 235. At this time, the second fixing section 238 of the heater base 235 may be extended at a front end of the connection section 237 of the heater base 235 in becoming more distance direction from the communication opening 213. Accordingly, the second fixing section 238 of the heater base 235 may be spaced substantially upward from the top face of the first cavity 210. Here, the fastening device that passes through the periphery of the reflector 230 may be fastened to the second fixing section 238.

In addition, the second fixing section 238 of the heater base 235 may be disposed over the top face of the first cavity 210, not on the communication opening 213. Accordingly, the fastening device that passes through the periphery of the reflector 230 and is fastened to the second fixing section 238 of the heater base 235, that is, the fastening device for fixing the reflector 230 to the second fixing section 238 of the heater base 235 is not to be exposed to the inside of the first cooking room 211.

Figure 4:
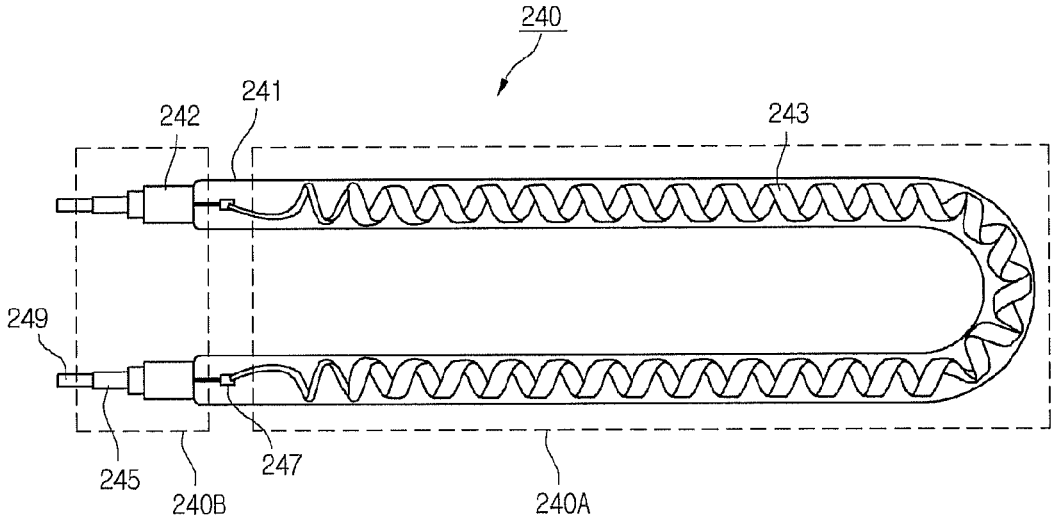
FIG. 4 is a plan view showing a carbon heater provided in the electric oven according to a first embodiment of the present invention.

Further, the carbon heater 240 may be provided over the communication opening 213. The carbon heater 240 may produce radiant energy of light and heat types for cooking food in the first cooking room 211. Here, the carbon heater 240 may be disposed on the reflector 230, substantially, the inside of the heater seating section 231. At this time, the carbon heater 240 may be disposed entirely in length direction of the reflector 230. In other words, the carbon heater 240 may be disposed lengthwise in a long side direction of the reflector 230. Referring to FIG. 4, in the present embodiment, the carbon heater 240 may include a tube 241, a filament 243, an insulator 245, a rod 247 and a terminal 249.

A quartz tube of an U-shape, for example, may be used for the tube 241. Further, an inert gas may be inserted in the tube and enveloped through an enveloping section 242 that is formed on both ends of the tube 241 for sealing the inside thereof. The enveloping section 242 may be formed by compressing the both ends of the tube 241.

The filament 243 may be disposed inside the tube 241. The filament 243 may be heated to produce radiant energy, that is, light and heat. The both ends of the filament 243 may be spaced at a preset distance from the enveloping section 242. Further, for example, the filament 243 may be formed by weaving a plurality of fiber made mainly of carbon.

The insulator 245 may be fixed by compressing the enveloping section 242. The insulator 245 serves to insulate the inner and outer parts of the tube 241.

The rod 247 may be connected to the both ends of the filament 243. The rod 247 serves to support the filament 243.

The terminal 249 may be connected to the filament 243 through the rod 247. The terminal 249 may be connected to a wire (not shown) and the current transmitted from the wire through the terminal 249 may be supplied to the filament 243.

Meanwhile, the carbon heater 240 may include substantially a heating section 240A and both ends 240B. The heating section 240A may be defined as a place where the filament 243 is disposed. Accordingly, the heat and light may be produced by the filament 243 in the heating section 240A. Further, the both ends 240B may be defined as a place where the filament 243 is not disposed, that is, the rest parts of the carbon heater 240 except for the heating section 240A, that is, the enveloping section 242, the insulator 245, the rod 247 and the terminal may be included therein. Accordingly, the light and heat is not produced by the filament 243 in the both ends 240B. Further, the both ends 240B may include the enveloping section 242.

The heating section 240A may be formed as a whole U-shape of open curved line having a curved line part and a straight line part. In addition, a section of the inner peripheral surface 231B of the heater seating section 231 may be formed as an U-shape, as described above. Accordingly, the shortest distance between the inner peripheral surface 231B of the heater seating section 231 and the heating section 240A may be set as a same value. Therefore, the radiant energy produced from the heating section 240A may be reflected at a same angle through the reflector 230. That is, the radiant energy from the carbon heater 240 may be transferred to the inside of the first cooking room 211, as set forth above. Further, the both ends 240B may be extended parallel with each other in a same direction at the end of the heating section 240A. In the present embodiment, the straight line part of the heating section 240A may be disposed lengthwise in front and rear side directions of the reflector 230.

Further, two carbon heaters 240 may be disposed in left and right side directions and spaced at a predetermined distance on the top face of the first cavity 210 such that the both ends 240B are directed to a rear face of the first cavity 210.

A part of the heating section 240A and the both ends 240B may be disposed on the inside of the reflector 230, substantially on the inside of the heater seating section 231. The rest part of the both ends 240B including the enveloping section 242 passes through the heater through-opening 232 and extends to the outside of the heater seating section 231. In other words, the heating section 240A and a part of the both ends 240B may be shielded by the reflector 230 and the rest part of the both ends 240B may be exposed to the outside of the reflector 230.

Further, the heating section 240A may be disposed on the communication opening 213 and the both ends 240B may be disposed over the first cavity 210. In other words, the projection of the heating section 240A in a vertical direction may pass through the communication opening 213 and be disposed on a floor face of the first cooking room 211. Further, the projection of the both ends 240B in a vertical direction that is extended to the outside of the reflector 230 may be disposed on the top face of the first cavity 210, specially, on the barrier section 233.

Referring again to FIG. 3, a first and second heater support holders 251, 258 may be provided for supporting the carbon heater 240. The first heater support holder 251 may support the both ends 240B. Further, the second heater support holder 257 may support the heating section 240A.

Figure 7:
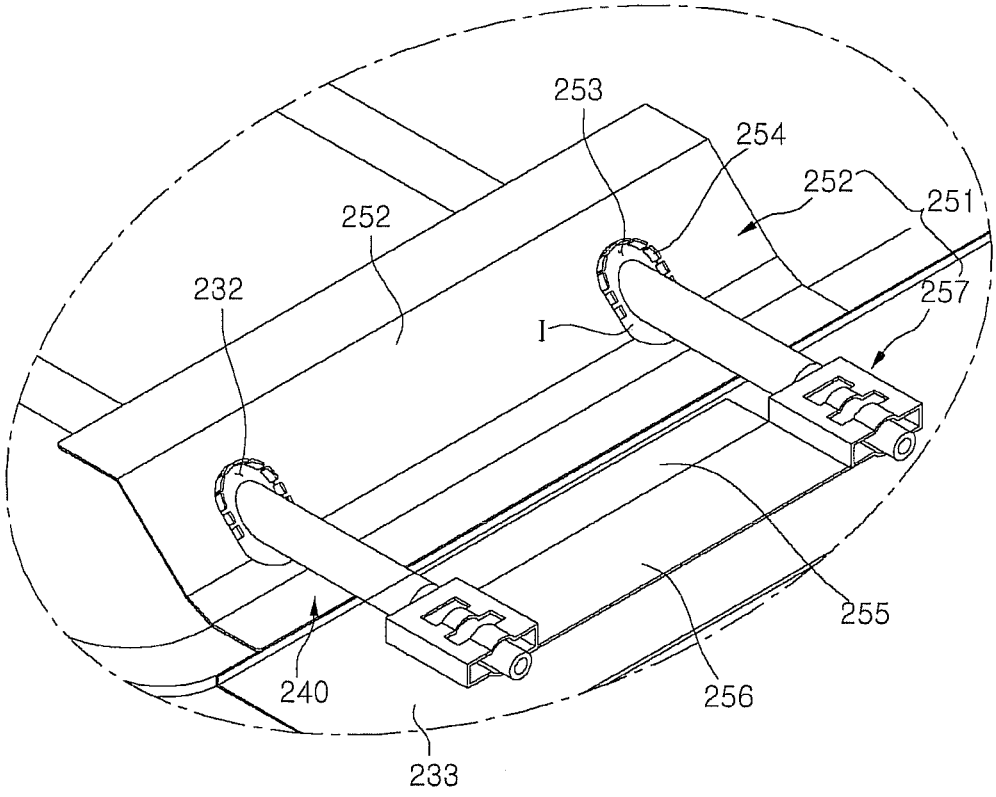
FIG. 7 is a perspective view showing main parts of the electric oven according to a first embodiment of the present invention.

Specially, referring to FIGS. 6 and 7, the first heater support holder 251 supports elastically the both ends 240B. For this purpose, the first heater support holder 251 may include a first fixing section 252, a first seating section 255 and a cover section 256.

The fixing section 252 of the first heater support holder 251 may be fixed to one face of the heater seating section 231 on which the heater trough-opening is formed and the top face of the reflector 230 adjacent to the one face of the heater seating section. Here, a heater through-hole 253, corresponding to the heater through-opening 232, may be formed on the first fixing section 252 of the first heater support holder 251. At this time, the heater through-hole 253 may be shaped and sized such that an outer peripheral surface of the tube 241 is not in contact with the inner peripheral surface thereof, as same as the heater through-opening 232. The heater through-hole 253, for example, may be circular form having a diameter that is equal to or greater than the diameter of the tube 241.

Further, a plurality of damper members 254 may be provided on the inner peripheral surface of the heater through-hole 253. The damper member 254 serves to prevent the tube 241 from being damaged by the end of the first fixing section 252 of the first heater support holder 251, corresponding to the inner peripheral surface of the heater through-hole 253. The damper member 254 may absorb external force between the tube 241 that is moved through external force while it is assembled or installed, the heater through-opening 232 and the heater through-hole 253. Further, the damper member may serve to prevent the tube 241 from being in contact with the heater through-opening 232 and the heater through-hole 253. Accordingly, the damper member may be named as a contact prevention member.

For this purpose, the damper member 254 may be bent at a predetermined angle with respect to the first fixing section 252 of the first heater support holder 251 in the inner peripheral surface of the heater through-hole 253 so that it may be elastically deformed with respect to the first fixing section 252 of the first heater support holder 251. At this time, the front end of the damper member 254 may be disposed adjacent to the outer peripheral surface of the tube 241, comparing to the base thereof that is extended from the heater through-hole 253. Further, the front end of the damper member 254 may be narrower in width than the base of the damper member 254 so that the contact area of the tube 241 with the damper member 254 decreases, comparing to the contact area with the heater through-opening 232 and the heater through-hole 253.

Additionally, an insulating material I may be provided between the reflector 230 and the first fixing section 252 of the first heater support holder 251. The insulation material I may serve to prevent the radiant energy of the carbon heater 240 from being leaked to the outside of the reflector 230 through the heater through-opening 232 and the heater through-hole 253. The insulating material I may be fixed by fixing the first fixing section 252 of the first heater support holder 251 to one face of the heater seating section 231.

Further, in the present embodiment, the insulating material I includes a first insulation material I1 and a second insulation material I2.

Here, a mesh made of metal, for example, copper sulfide, may be used for the first insulating material I1. Further, a sheet made of ceramic glass may be used for the second insulating material I2. Further, one face of the first insulating material I1 may be in closely contact with one face of the heater seating section 231. Meanwhile, one face of the second insulating material I2 may be in closely contact with one face of the first heater support holder 251. The other faces of the first and second insulating material I1 and I2 may be in closely contact with each other. In other words, the first insulating material I1 may be disposed relatively adjacent to the reflector 230 and the second insulating material I2 may be disposed relatively adjacent to the first heater support holder 251. Accordingly, the ceramic glass constituting the second insulating material I2 may not be exposed to the inside of the reflector 230 and the inside of the cooking room 211 through the heater through-opening 232.

The first seating section 255 of the first heater support holder 251 may be bent at a predetermined angle in a lower end of the first fixing section 252 of the first heater support holder 251. The first seating section 255 of the first heater support holder 251 may be extended vertically to be elastically deformed with respect to the first fixing section 252 of the first heater holder 251. Here, a part of the outer peripheral surface of the both ends 240B, that is, the lower part of the outer peripheral surface of the both ends 240B may be seated on the first seating section 255 of the first heater support holder 251. Accordingly, the first seating section 255 of the first heater support holder 251 may be shaped, corresponding to a part of the outer peripheral surface of the both ends 240B.

The cover section 256 of the first heater support holder 251 may serve to prevent the both ends 240B that is seated on the first seating section 255 of the first heater support holder 251 from being moved voluntarily. For this purpose, the cover section 256 of the first heater support holder 251 may be shaped, corresponding to the rest of the outer peripheral surface of the both ends 240B that is seated on the first seating section 255 of the first heater support holder 251, that is, the upper part of the outer peripheral surface of the both ends 240B. The cover section 256 of the first heater support holder 251 may be connected to the first seating section 255 of the first heater support holder 251 while the lower part of the outer peripheral surface of the both ends 240B is seated on the first seating section 255 of the first heater support holder 251.

Referring again FIG. 3, the second heater holder 257 may support one side of the heating section 240A, that is, a boundary of the straight line part and the curved line part of the heating section 240A in the present embodiment. The second heater support holder 257 may include a second support section 258 and a second fixing section 259.

The second support section 258 of the second heater support holder 257 may be open-curved line of a ring shape. The second support section 258 of the second heater support holder 257 may have a diameter that is equal to or greater than the diameter of the tube 241. Accordingly, a part of the outer peripheral surface of the heating section 240A may be supported on the inner face of the second support section 258 of the second heater support holder 257.

The second fixing section 259 of the second heater support holder 257 may be extended at one end of the second support section 258 of the second heater support holder 257. The second fixing section 259 of the second heater support holder 257 may be fixed to the inner face of the reflector 230, specially, the inner face of the heater seating section 231.

Meanwhile, the grate 260 may be provided on the communication opening 213. The grate 260 may be provided substantially on the heater base 235. The grate 260 may server to transfer the radiant energy of the carbon heater 240 to the inside of the first cooking room 211 and prevent the carbon heater 240 from being damaged by external substance.

The grate 260 may have a bottom surface, corresponding to a cross-section of the communication opening 213 and/or the heater base 235 and be shaped as a flat polyhedron in which a top face is opened. At this time, a floor face of the grate 260 may be sized less than a cross-section of the communication opening 213 and/or the heater base 235 to prevent interference between the grate 260 and the communication opening 213 and/or the heater base 235.

Figure 5:
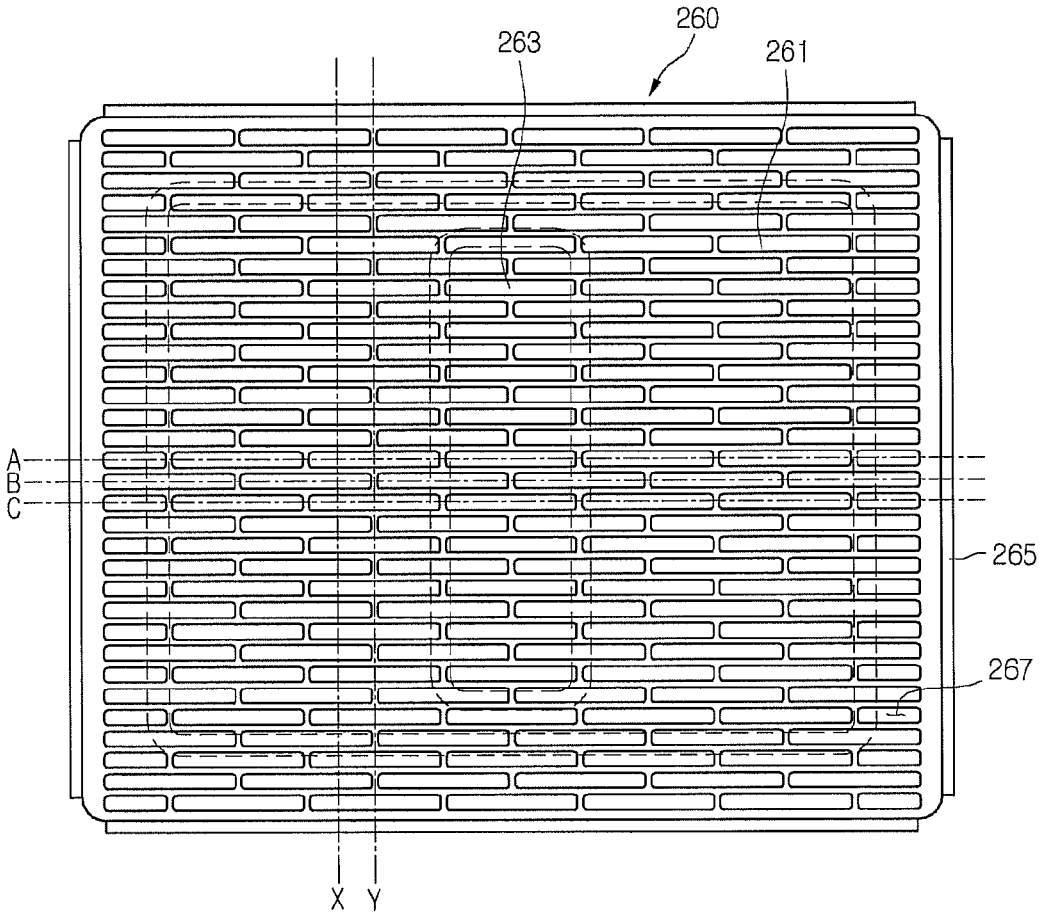
FIG. 5 is a plan view showing grate provided in the electric oven according to a first embodiment of the present invention.

Referring to FIGS. 3 and 5, the grate 260 may include a forming section 261. The forming section 261 may be configured by forming upward a part of the grate 260, comparing to the rest of the grate 260. The forming section 261 may serve to prevent the grate 260 from being thermally deformed by the radiant energy of the carbon heater 240.

Further, a first reflector fixing section 263 may be provided on the grate 260. The first reflector fixing section 263 may be configured by forming upward a part of the grate 260, comparing to the rest of the grate 260. In the present embodiment, the first reflector fixing section 263 may be configured by forming further a part of the forming section 261, comparing to the rest of the forming section 261. The first reflector fixing section 263 is a place that is fixed to the bottom central part of the reflector 230. Accordingly, the forming section 261 and the first reflector fixing section 263 may be configured by forming doubly a part of the grate 260.

Further, a second reflector fixing section 265 may be provided on upper end of the peripheral surface of the grate 260. The second reflector fixing section 265 may be extended horizontally to the upper end of the peripheral surface of the grate 260. The second reflector fixing section 265 may be fixed to the bottom face periphery of the reflector 230. The periphery of the reflector 230 may be fixed to the second fixing section 238 of the heater base 235 by using a fastening device while the second reflector fixing section 265 is fixed to the bottom face periphery of the reflector 230, and thus the reflector 230, the heater base 235 and the grate 260 are in closely contact with each other.

A plurality of communication holes 267 may be formed in the grate 260. The communication hole 267 may be formed by punching the bottom face of the grate 260. The communication hole 267 may be formed on entire bottom face of the grate 260, including the first reflector fixing section 263.

In the present embodiment, the communication hole 267 may be formed lengthwise in the left and right side directions of the grate 260. In other words, the communication hole 267 may be formed lengthwise in a perpendicular direction to the straight line part of the heating section 240A wherein the straight line part of the heating section 240A is disposed lengthwise in front and rear side directions of the grate 260. Accordingly, the straight line part of the heating section 240A may intersect alternatively the bottom face of the grate 260, corresponding to any one of the communication holes 267, and a place between a column formed by any one of the communication holes 267 and another column adjacent to the column.

Further, the communication holes 267 may form a plurality of rows in left and right side directions of the grate 260. Further, the respective row formed by the communication hole 267 may be spaced at a predetermined distance in front and rear side directions of the grate 260. At this time, the both ends of the communication hole 267 constituting one row (indicated as line A or B in FIG. 5) and the both ends of the communication hole 267 constituting another row (indicated as line B or C in FIG. 5) adjacent to the one row may be disposed not to be overlapped in a parallel direction to the straight line part of the heating section 240A.

Accordingly, the imaginary line (indicated as line X or Y in FIG. 5) extending in parallel to the straight line part of the heating section 240A may interest at least one of the communication holes 267. In more detail, the line X intersects alternatively one of the communication holes 267 constituting one row A and a part of the floor face of the grate 260 corresponding to a place between the row A and another row B. Further, the line Y intersects alternatively one of the communication holes 267 constituting one row A, a part of the floor face of the grate 260 corresponding to a place between the row A and another row B, a part of the floor face of the grate 260 corresponding to a place between the communication holes 267 constituting the another row B, and a part of the floor face of the grate 260 corresponding to a place between the row B and another row C. That is, the line Y extends through both ends of one of the communication holes 267, constituting one row B in parallel to the straight line part of the heating section 240A, and intersects other two of the communication holes 267 constituting other row A and row C adjacent to the row B. Further, the straight line part of the heating section 240A may be disposed on the line X and/or the line Y depending on a relative location with respect to the grate 260.

A shape and location of the communication hole 267 is determined to minimize or prevent the interference of the radiant energy transmission from the carbon heater 240 into the cooking room 211 by the floor face of the grate 260 corresponding to the communication holes 267 constituting adjacent rows A and B (or B and C) or the floor face of the grate 260 corresponding to a place between the communication holes 267 constituting same row. That is, the shape and location of the communication hole 267 is determined to prevent a phenomenon in which the radiant energy from the carbon heater 240 is interfered by the floor face of the grate 260 except for the communication hole 267 and is not transferred into the cooking room 211.

In the present embodiment, the reflector 230, the carbon heater 240 and the grate 260 are fixed together to form an unit and fixed to the first cavity 210. That is, the grate 260 is fixed to the reflector 230 while the carbon heater 240 is fixed to the reflector 230 by the first and second heater support holders 257. Further, the carbon heater 240 and the grate 260 that are fixed as described above may be fixed to the first cavity 210, that is, the heater base, which will be described later.

Referring again FIG. 3, an insulation material cover 270 may be provided over the reflector 230. The insulation material cover 270 may serve to fix the insulation material (not shown) that is disposed between the bottom face thereof and the top face of the reflector 230. For this purpose, the insulation material cover 270 may be formed as polyhedron shape in which a bottom face is opened. At this time, the top face of the insulation material cover 270 may be formed to have a size of equal to or greater than the reflector 230. Further, the insulation material cover 270 may be fixed to the heater base 235 while it is seated on the top face periphery of the reflector 230.

A latch seating section 271 may be provided on the front end of the insulation material cover 270. The latch seating section 271 may be formed by depressing a part of the front end central part of the insulation material cover 270. A latch hook assembly 291, which will be described latter, may be seated on the latch seating section 271.

Meanwhile, a sheath heater 280 may be provided inside the first cooking room 211. In the present embodiment, the sheath heater 280 may be formed as a serpentine shape with being bent multi-times and the both ends thereof may pass through a rear face of the first cavity 210. The sheath heater 280 may provide the radiant energy, that is, heat for cooking food inside the first cooking room 211.

Further, a locking device may be provided on the first oven section 200. The locking device may serve to limit the opening of the first door 220 for opening the first cooking room 211. For example, the locking device may limit the opening of the first door 220 while pyrolysis cleaning operation is performed by burning the foreign substance attached to the inner face of the first cooking room 211. The locking device may include a latch hook assembly 291 latched to the first door 220, a latch motor for supply power to operate the latch hook assembly 291, and a latch bar 295 for transferring the driving force from the latch motor 293 to the latch hook assembly 291.

Referring again FIGS. 1 and 2, the second oven section 300 may include a second cavity 310 provided with a second cooking room 311 and a second oven door 320 for opening and closing alternatively the second cooking room 311.

Further, a heating source may be provided also in the second oven section 300 for cooking food in the second cooking room 311. In the present embodiment, a broil heater 330, a bake heater 340 and a convection device 350 may be provided in the second oven section 300. The broil heater 330 may be arranged over the second cooking room 311. Further, the bake heater 340 may be arranged under the second cooking room 311. The convection device 350 may be arranged on a rear face of the second cooking room 311. Here, the configurations of the broil heater 330, the bake heater 340 and the convention device 350 have been known and thus detailed descriptions thereof are omitted.

Even not shown, a locking device may be provided on the second oven section 300. The locking device may limit the opening of the second door 320 for opening the second cooking room 311 while the second cooking room 311 is shielded. The locking device may be configured as same as the locking device in the first oven section 200.

Meanwhile, referring to FIG. 2, an exhaust duct section 500 may be provided in the main body 1. The exhaust duct section 500 may serve to discharge the combustion gas produced while food is cooked in the first and second oven sections 200 and 300.

Hereinafter, an operation of the first embodiment of the electric oven according to the present invention will be described.

First, the carbon heater 240 and/or the sheath heater 280 are operated depending on a user' choice while food is received inside the first cooking room 211. Accordingly, the food inside the first cooking room 211 is prepared by the radiant energy that is transmitted from the carbon heater 240 and/or the sheath heater 280 to the inside of the first cooking room 211.

In more detail, the current supplied through the wire is transmitted to the filament 243. Further, light and heat is produced through electric resistance of the filament 243. The light and heat produced in the filament 243 is supplied to the inside of the first cooking room 211 through the communication opening (heat transfer opening) 213 and the communication hole 267. At this time, the light and heat produced in the filament 243 is reflected to the inside the first cooking room 211 through the reflector 230. Further, the food is heated by the light and heat supplied from the carbon heater 240 to the inside of the first cooking room 211 and the food is prepared inside the first cooking room 211.

Here, as described above, the communication hole 267 is disposed such that any one of the communication holes 267 constituting any one row, a bottom face of the grate 260 corresponding a place between the communication holes 267 constituting another row adjacent to the one row, and a bottom face of the grate 260 corresponding to a place between the communication holes 267 constituting any one row are not overlapped consecutively and vertically with the straight line part of the heating section 240A of the carbon heater 240. Accordingly, while the light and heat from the carbon heater 240 is transferred to the inside of the first cooking room 211, the interference through the grate 260 can be minimized. That is, the cooking of food inside the first cooking room 211 by the carbon heater 240 can be made efficiently.

Further, the grate may be fixed to the reflector 230 and the forming section 261 may be provided on the grate 260. Accordingly, the grate 260 can be prevented from being thermally deformed or drooped by the radiant energy from the carbon heater 240.

In addition, only a part of the carbon heater 240 may be disposed inside the reflector 230, and the rest thereof may be disposed outside the reflector 230. That is, the heating section 240A and a part of the both ends 240B of the carbon heater 240 are disposed inside the reflector 230 and the rest of the both ends 240B, including the enveloping section 242, is disposed outside the reflector 230. Accordingly, at least a part of the both ends 240B, including the enveloping section 242 can be minimized to be influenced by the light and heat produced from the carbon heater 240. Further, a part of the both ends 240B that is disposed outside the reflector 230 is radiated inside the main body 1.

Additionally, the barrier section 233 prevents the heat inside the first cooking room 211 from being transferred to the both ends 240B through the first cavity 210. Accordingly, heat loss of the both ends 240B can be minimized.

While the present invention has been described with respect to the specific embodiments, it will be apparent to those skilled in the art that various changes and modifications may be made without departing from the spirit and scope of the invention as defined in the following claims.

BEST MODE FOR THE INVENTION

Hereinafter, a second embodiment of the electric oven according to the present invention will be described in detail, referring to the accompanied drawings.

Figure 8:
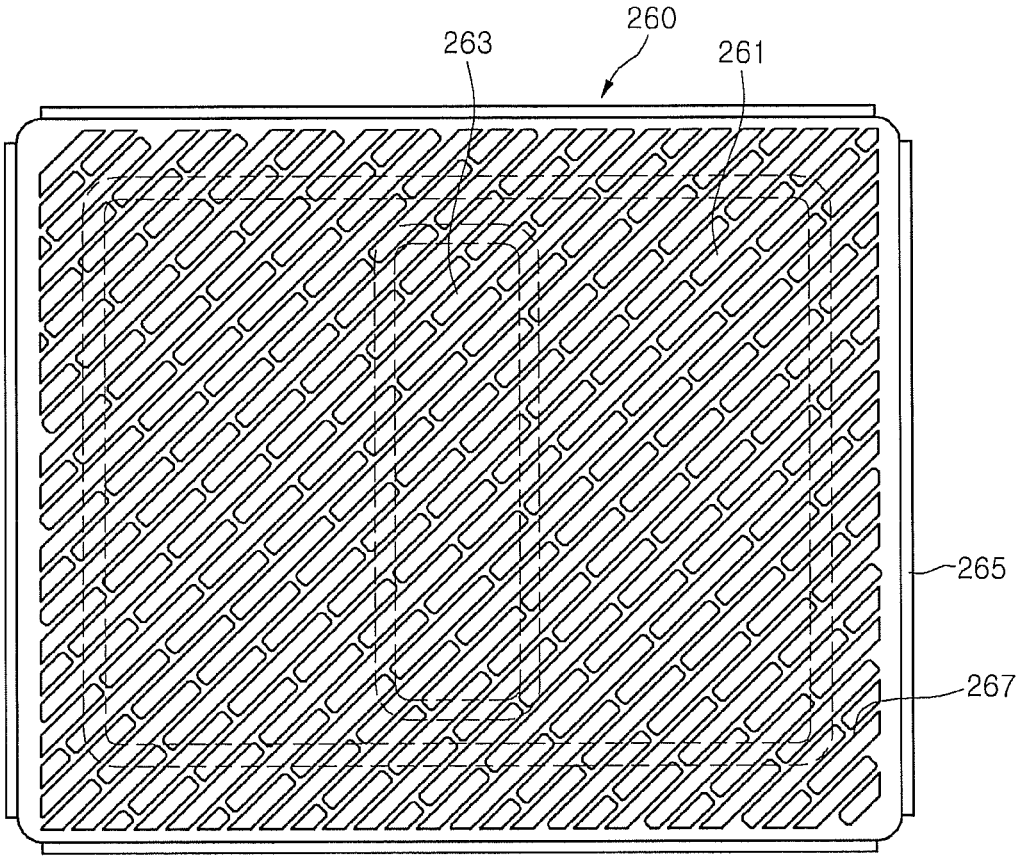
FIG. 8 a plan view showing grate provided in an electric oven according to a second embodiment of the present invention.

FIG. 8 is a plan view showing grate according to a second embodiment of the electric oven of the present invention.

Referring to FIG. 8, in the present embodiment, the communication holes 267 provided in the grate 260 are formed lengthwise in parallel to imaginary lines that are inclined at a preset angle with respect to front and rear side directions and/or left and right side directions of the grate 260. In the present embodiment, the communication holes 267 are inclined with respect to the imaginary lines extending to a parallel direction with the straight line part of the heating section 240A. Accordingly, in the present embodiment, as same as the first embodiment, the interference of radiant energy transference from the carbon heater 240 to the inside of the first cooking room 211 by the floor face of the grate 260 corresponding to a place between the communication holes 267 can be prevented.

What is claimed is:

1. An electric oven, comprising:

a cavity including an oven chamber and to which a communication opening is formed;

a door that opens and closes the oven chamber;

a carbon heater that provides radiant energy to the inside of the oven chamber through the communication opening and provided above the communication opening;

a reflector to reflect the radiant energy from the carbon heater to the inside of the oven chamber, a portion of the reflector arranged above and covering the carbon heater; and a grate which is fixed to the reflector and is provided on the communication opening and includes a forming section, a part of which is formed toward the reflector, wherein the reflector includes a heater seating section and a grate fixing section, and the heater seating section includes a top surface and a peripheral surface extended downward from the top surface, wherein the peripheral surface includes a heater-through opening through which the heater passes, wherein the grate includes a reflector fixing section fixed to a lower surface of the grate fixing section, and wherein the grate fixing section and the reflector fixing section are provided under the carbon heater.

2. The electric oven of claim 1, wherein the grate is fixed to the cavity and the reflector.

3. The electric oven of claim 1, wherein a part of the forming section and a periphery of the grate are fixed to the reflector.

4. The electric oven of claim 3, wherein the forming section includes an additional reflector fixing section formed toward the reflector.

5. The electric oven of claim 1, wherein the heater seating section surrounds the heater, the top surface is haped corresponding to the shape of the heater; and the peripheral surface is inclined at a preset angle with respect to the rest of the reflector.

6. The electric oven of claim 5, wherein a first projection of the top surface that is projected on one surface of the oven chamber through the communication opening is similar in shape to a second projection of the heater that is projected on the one surface of the oven chamber through the communication opening.

7. An electric oven, comprising:

a cavity including an oven chamber and to which a communication opening is provided;

a carbon heater that provides the radiant energy to the inside of the oven chamber and includes a straight line part, the carbon heater being arranged above the communication opening;

a reflector to reflect the radiant energy of the carbon heater to the inside of the oven chamber, wherein a portion of the reflector is provided above the carbon heater and covers the carbon heater, and a grate which is arranged on the communication opening and to which a plurality of communication holes that transfer the radiant energy from the carbon heater to the inside of the oven chamber are provided, wherein the reflector includes a heater seating section and a grate fixing section, and the heater seating section includes a top surface and a peripheral surface extended downward from the top surface, wherein the grate fixing section is extended from a lower end of the peripheral surface in a horizontal direction, wherein the peripheral surface includes a heater-through opening through which the heater passes, wherein the grate includes a reflector fixing section fixed to a lower surface of the grate fixing section, wherein the grate fixing section and the reflector fixing section are provided under the carbon heater, and wherein the communication holes are formed lengthwise in another direction except for the parallel direction with the straight line part of the carbon heater.

8. The electric oven of claim 7, wherein the communication holes are perpendicular to the straight line part of the carbon heater.

9. The electric oven of claim 7, wherein an extending direction of each of the communications holes intersects an extending direction of the straight line part of the carbon heater.

10. An electric oven, comprising a cavity including an oven chamber and to which a communication opening is provided;

a carbon heater that provides the radiant energy to the inside of the oven chamber and includes a straight line part, the carbon heater provided above the communication opening;

a reflector to reflect the radiant energy of the carbon heater to the inside of the oven chamber, wherein a portion of the reflector is arranged above the carbon heater and covers the carbon heater; and a grate which is provided on the communication opening and to which a plurality of communication holes that transfer the radiant energy from the carbon heater to the inside of the oven chamber are provided, wherein the reflector includes a heater seating section and a grate fixing section, and the heater seating section includes a top surface and a peripheral surface extended downward from the top surface, wherein the peripheral surface includes a heater-through opening through which the heater passes, wherein the rate includes a reflector fixing section fixed to a lower surface of the grate fixing section, wherein the grate fixing section and the reflector fixing section are provided under the carbon heater, and wherein the communication holes are extended at a preset angle and form rows in a direction perpendicular to the extended direction, and the imaginary lines in parallel with the straight line part of the carbon heater intersect at least one of the communication holes.

11. The electric oven of claim 10, wherein the imaginary line in a direction parallel with the straight line part of the carbon heater intersects perpendicularly the imaginary line in a direction parallel with the row formed by the communication hole.

12. The electric oven of claim 10, wherein the imaginary line in a direction parallel with the straight line part of the carbon heater intersects at a preset angle the imaginary line in a direction parallel with the row formed by the communication hole.

* * * * *